US005118202A

United States Patent [19]

Bruno

[11] Patent Number: 5,118,202

[45] Date of Patent: Jun. 2, 1992

[54] TAMPER PROOF, RECLOSEABLE PLASTIC BAG CONTAINING AN OBJECT AND METHOD OF MAKING THE SAME

[76] Inventor: Edward C. Bruno, 15336 E. Penwood Pl., Aurora, Colo. 80015

[21] Appl. No.: 574,138

[22] Filed: Aug. 29, 1990

Related U.S. Application Data

[63] Continuation-in-part of Ser. No. 318,622, Mar. 2, 1989.

[51] Int. Cl.[5] ..... B65D 33/24

[52] U.S. Cl. ..... 383/37; 383/61; 383/63; 383/66; 383/203

[58] Field of Search ..... 383/37, 61, 63, 5, 66; 206/610

[56] References Cited

U.S. PATENT DOCUMENTS

| | | | |
|---|---|---|---|
| 3,254,468 | 6/1966 | Lerner | 383/37 X |
| 3,254,828 | 6/1966 | Lerner | 383/37 |
| 3,827,472 | 8/1974 | Vramoto | 383/63 X |
| 3,948,705 | 4/1976 | Ausnit | 393/37 X |
| 4,262,581 | 4/1981 | Ferrell | 383/37 X |
| 4,401,213 | 8/1983 | Lerner | 383/37 X |
| 4,550,831 | 11/1985 | Whitford | 383/37 X |
| 4,589,145 | 5/1986 | Van Erden et al. | 383/63 X |
| 4,654,878 | 3/1987 | Lems | 383/63 X |
| 4,709,533 | 12/1987 | Ausnit | 383/61 X |
| 4,756,629 | 7/1988 | Tilman et al. | 383/63 |
| 4,759,642 | 7/1988 | Van Erden et al. | 383/63 |
| 4,832,505 | 5/1989 | Ausnit et al. | 383/63 X |
| 4,846,585 | 7/1989 | Boeckmann et al. | 383/5 |
| 4,848,928 | 7/1989 | Ausnit | 383/5 |
| 5,007,744 | 4/1991 | Scarberry et al. | 383/61 X |

FOREIGN PATENT DOCUMENTS

| | | | |
|---|---|---|---|
| 549840 | 12/1957 | Canada | 383/66 |

*Primary Examiner*—Stephen Marcus
*Assistant Examiner*—Jes F. Pascua
*Attorney, Agent, or Firm*—Leo J. Aubel

[57] ABSTRACT

A recloseable plastic bag containing an object and a method of making the bag. A plastic tube having cooperating snap fit members protruding from the surface of said tube extending along the length of the tube, adjacent to one lateral edge is provided. The tube is heat sealed along a series of spaced apart lines extending from one lateral edge to an opposite lateral edge. An area of the protruding snap fit members is heat sealed and flattened. A perforated line is formed to extend across the tube and said flattened area. The tube is slit adjacent to each of the heat seal lines and may receive an object in slitted side of the formed bag. The resulting bag may be conveniently severed from the tube along the perforated line.

2 Claims, 3 Drawing Sheets

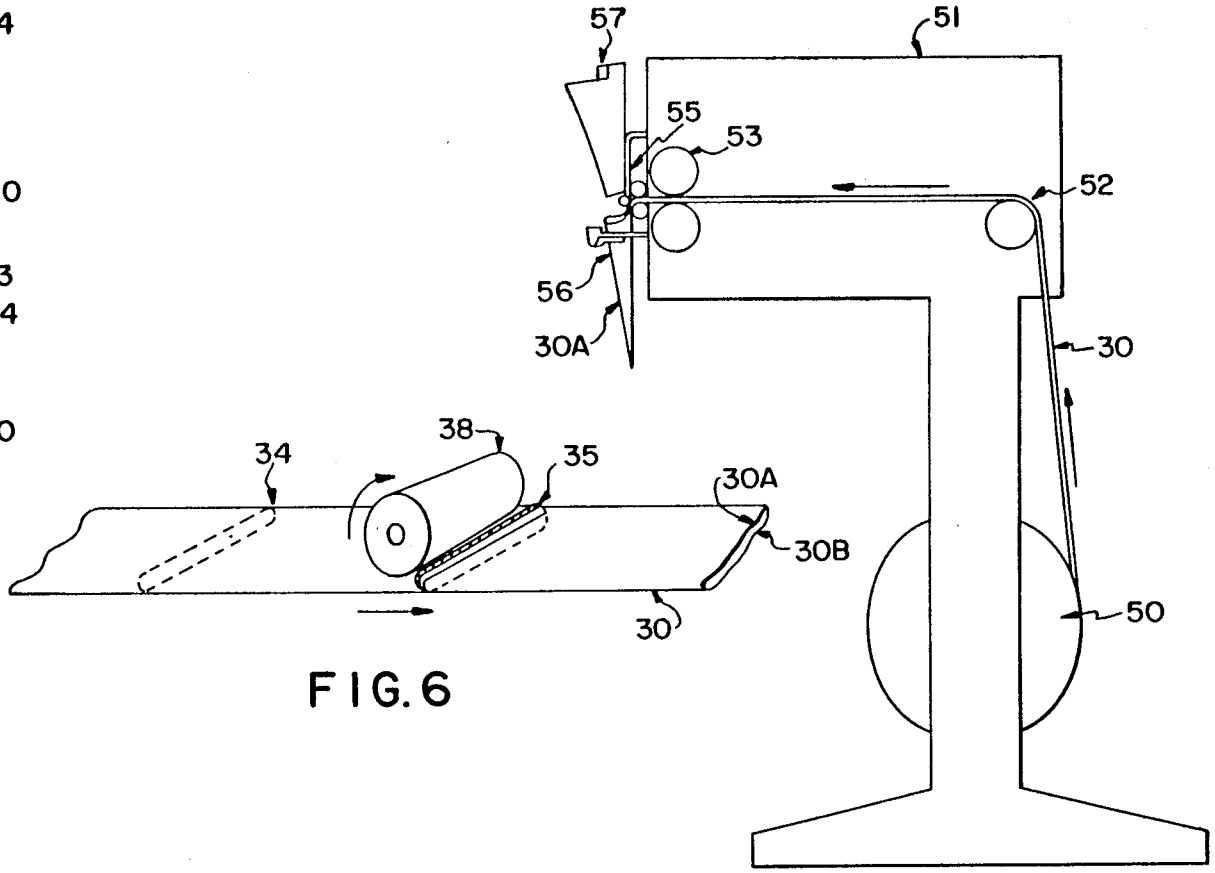
FIG. 7
FIG. 6
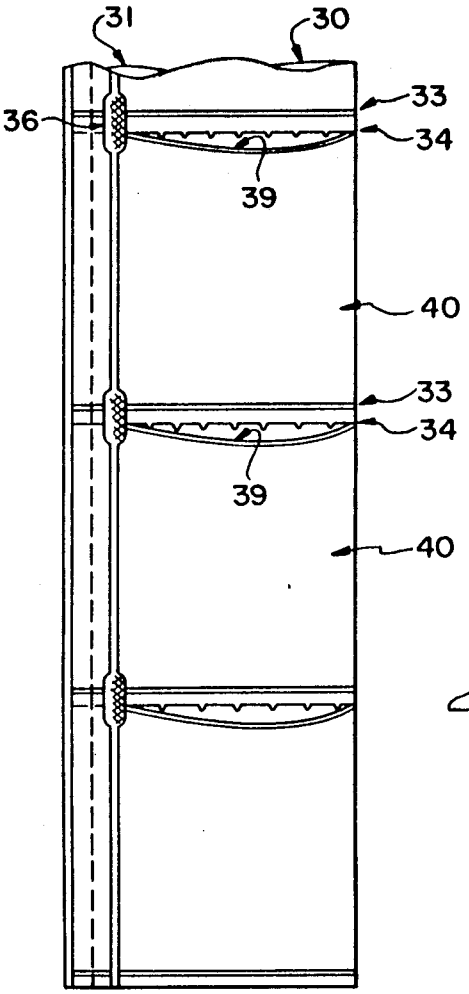
FIG. 5

TAMPER PROOF, RECLOSEABLE PLASTIC BAG CONTAINING AN OBJECT AND METHOD OF MAKING THE SAME

BACKGROUND OF THE INVENTION

This is a continuation-in-part of U.S. patent application Ser. No. 07/318,622, filed Mar. 2, 1989, of the same inventor.

A wide variety of items such as candy are packaged in sealed plastic bags. A conventional process for packaging objects such as candy in plastic bags is by providing a flattened plastic tube such that the tube contains a top portion and a bottom portion.

The top portion and the bottom portion are then heat sealed along a series of regularly spaced lines extending from one lateral edge to the other lateral edge of the flattened tube. The top portion is then slit from one lateral edge to the other lateral edge of the tube in a line adjacent to and spaced from each heat seal line. The bottom portion is perforated in a line directly beneath the slit.

An object such as candy is inserted through the slit and into the interior of the tube, and then the top portion and bottom portion are heat sealed along another line extending from one lateral edge to the other lateral edge of the tube adjacent to the slit and the perforated line. Lastly, the tube is severed along the perforated line, thereby forming a sealed bag containing the candy.

Although the aforementioned plastic bags are tamper proof in the sense that a tear or puncture in the bag would immediately raise suspicions that there might have been tampering with the object, such bags are not recloseable once they are opened in the normal, intended manner.

A conventional manner of making a recloseable plastic bag is to form a flattened plastic tube possessing cooperating male profile and female profile members on the inside of the tube, along, but spaced from, one lateral edge. The tube is then passed beneath a heated knife which simultaneously severs the tube from one lateral edge to the other lateral edge while heat sealing both severed edges of the tube along the sever line. The heated knife severs and seals the tube at regular intervals, thereby forming bags of uniform size. The bags are then severed along the first lateral edge, near the male and female profile members.

SUMMARY OF THE INVENTION

The present invention relates to a tamper proof, recloseable plastic bag containing an object and a method of making the same.

First, a plastic tube having a first lateral edge and a second lateral edge and having cooperating snap fit members extending along the interior of the tube, adjacent to the first lateral edge is provided. Second, the tube is heat sealed along a series of spaced apart lines extending from one lateral edge to the other lateral edge. The tube is then slit adjacent to each of the heat seal lines, and then an object is inserted through the slitted portion of the tube and into the interior of the tube.

Finally, the tube is heat sealed along a line adjacent to the slit such that the object contained within the tube is sealed from the exterior of the tube by the two lateral edges, one first heat sealed line, and one second heat sealed line. The resulting bag may be severed along the first lateral edge to provide access to the object, and the bag may be reclosed by joining the snap fit members together. A tamper proof, recloseable plastic bag containing an object as performed by the method is also disclosed.

BRIEF DESCRIPTION OF THE DRAWINGS

The present invention will be described with reference to the accompanying drawings wherein:

FIG. 5 is a view partially in section of a second embodiment of a tube of the present invention and shows a method of making said embodiment.

FIG. 6 is a view showing a tube engaged by a lobe or eccentric shaped roller at a point of perforation of the tube.

FIG. 7 shows a method of filling the bags formed from the tube of the invention.

DESCRIPTION OF A PREFERRED EMBODIMENT

The present invention will be described with reference to the accompanying drawings wherein like reference numberals refer to the same item.

Figure 1:
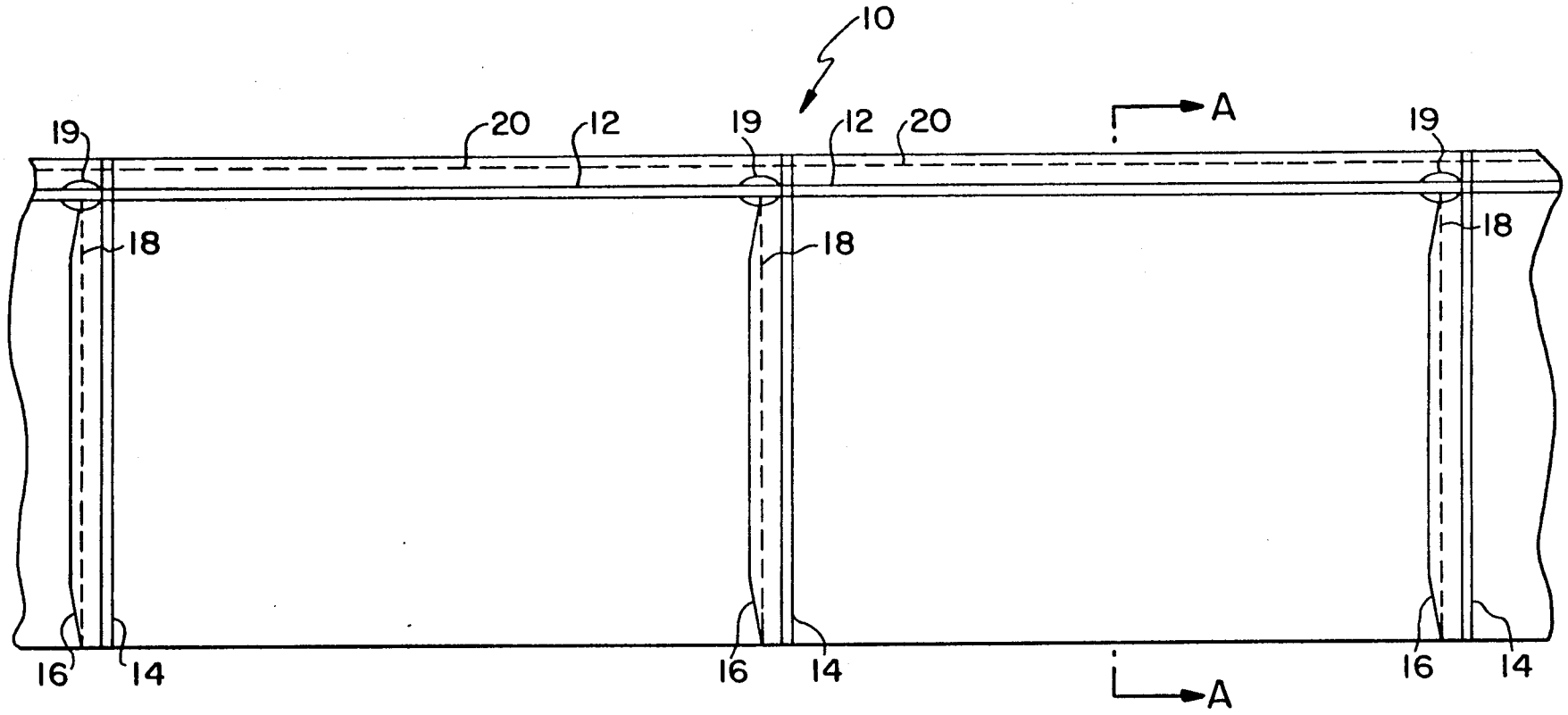
FIG. 1 is a plain view of a tube used in the method of the present invention in a condition prior to inserting an object through the slit and into the interior of the tube.
Figure 2:
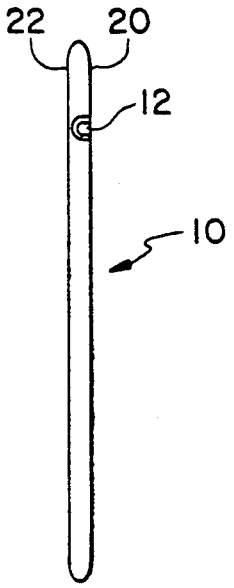
FIG. 2 is a cross-sectional view of the tube shown in FIG. 1 taken along the line A—A.

There is shown in FIG. 1 a flattened tube 10 formed of a plastic such as polypropylene or polyethylene. The flattened tube thus possesses a top portion and a bottom portion. A male profile member and a female profile member extend along opposing interior surfaces of the top portion and the bottom portion. The male and female profile members 12 may selectively join together in a snap-fit manner and may be selectively disengaged from such joinder by pulling the members 12 apart.

One of the members 12 is formed on the inside surface of the top portion of the flattened tube 10, and the other cooperating member 12 is formed on the inside surface of the bottom portion of the flattened tube 10 in an opposing relation. The members 12 extend along and adjacent to, yet spaced slightly from, a first one of the two lateral edges of the flattened tube 10. Such members 12 are formed on the flattened tube 10 in a well-known manner.

The flattened tube 10 passes beneath a heated bar (not shown) which heat seals the top portion and the bottom portion of the flattened tube 10 along a line 14 extending from the first lateral edge to the second lateral edge of the flattened tube 10 at regular, spaced intervals along the flattened tube 10. In this operation of the heated bar, the flattened tube 10 is heat sealed, but not severed.

The top portion of the flattened tube 10 is slit from the second lateral edge approximately to the male and female profile members 12 along a line substantially parallel to and adjacent to, yet spaced slightly from, each heat sealed line 14. Also, the flattened tube 10 is perforated along a line 18 on the bottom portion of the flattened tube 10. These slitting and perforation operations may also be performed in well-known manners.

A heat sealed spot welder (not shown) preferably heats the flattened tube 10 in the region of the intersection of the male and female profile members 12 and the slit 16 and the perforated line 18 as designated by the circles 19. Also, the flattened tube 10 is perforated along opposing lines 20, 22 adjacent to the first lateral edge, between the male and female profile members 12 and the first lateral edge. The heat sealed spot weld helps insure that the joined male and female profile members 12 do not become separated during the insertion of the object into the interior of the flattened tube 10.

Figure 4:
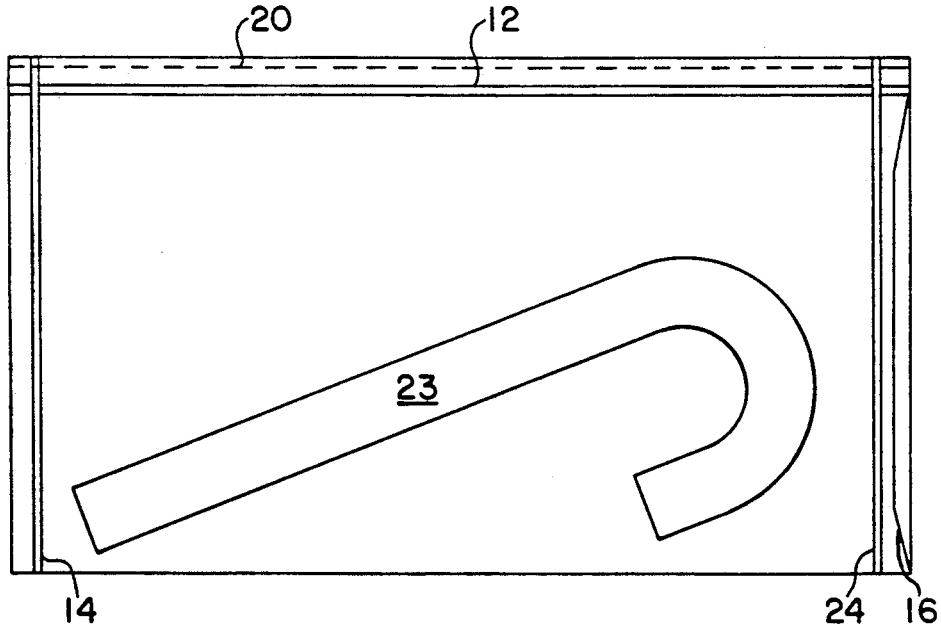
FIG. 4 is a plain view of a tamper proof, recloseable plastic bag containing an object in accordance with the present invention.

An object such as candy (such as one or more candy canes, 23 shown in FIG. 4) is inserted into the interior of the tube 10 through the opening formed by the slit 16 simply by pulling the top portion of the flattened tube 10 away from the bottom portion of the flattened tube 10 in the vincinity of the slit 16 and inserting the object.

Figure 3:
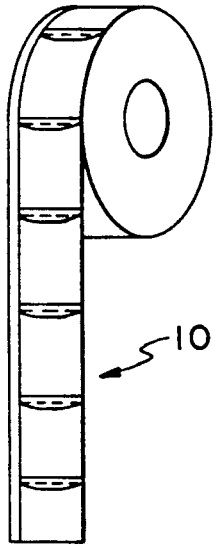
FIG. 3 is a perspective view of a roll of tube shown in FIG. 1 illustrating how the objects may be inserted through the slit and the interior of the tube in an easy, continuous operation.

This operation may be performed manually or by appropriate machinery. In order to maintain the object in the interior of the tube, it is preferable that the flattened tube 10 travel from a higher elevation to a lower elevation, such as shown in FIG. 3. Such an arrangement of the flattened tube 10 will cause the object to move downwardly from gravity within the flattened tube 10 until it abuts the heat sealed line 14 away from the slit 16.

Lastly, a second heated bar (not shown) heat seals the flattened tube 10 along a line 24 extending from one lateral edge to the other lateral edge of the flattened tube 10 adjacent to the slit 16 such that the object is confined within the flattened tube 10 by the two lateral edges, by a first heat sealed line 14, and by a second heat sealed line 24. The flattened tube 10 is then severed along each perforated line 18, thereby forming an independent, discrete recloseable plastic bag containing the object.

If purchaser sees that the bag has been ripped, or torn, or punctured, then the purchaser might reasonably suspect that there has been tampering with the object. The purchaser may gain access to the object by tearing the plastic bag along the perforated lines 20, 22, and by pulling apart the male and female profile members 12. The male and female profile members 12 together, to form an air-tight seal.

A second embodiment of a tube labeled 30 for forming bags 40 is shown in FIG. 5. FIG. 5 is also useful in explaining the method of making bags 40 from tube 30. The tube 30 has male and female profile members or zippers 31 similar in form and function to the profile members 12 of the tube 10 shown in FIGS. 1–4. Profile members 31 are relatively thicker than the film material of tube 30 and protrude from the surface of the tube.

The tube 30 shown in the flattened condition is heat sealed along lines 33 in a similar manner as tube 10 is shown in FIGS. 1–4. The tube 30 is perforated along a line 34 parallel to the profile members 31 for subsequent severance similarily as tube 10.

Importantly, tube 30 includes a relative thick flattened area 36. The flattened area 36 is formed by heating and pressing down the profile members 31.

The perforated line 34 is formed on the two sides or surface of the flattened tube 30. Perforated line 34 is parallel to, and adjacent heat seal line 33. The flattened area 36 overlaps and extends across a portion of the preforated line 34 and heat seal line 33.

The perforated line 34 is cut or formed after the flattened area 36 is formed. The perforating device forming the perforated line 34 has to cut through the flattened area 36 which is, as mentioned above, relatively thick as it is formed by material including the profile members 31. Area 36 provides a strong seal for the bags 40 while the perforations cross the area 36 enable the operator or user to easily detach each formed bag 40 from the tube 30.

One method of forming a slit or opening is shown in FIG. 6, a lobe or eccentric shaped roller 38 traveling in the opposite direction of the film is used to contact (as at 35) one side of tube 30 along the line of the perforation 34. When the roller 38 contacts the side 30A of tube 30 it causes drag on the surface of side 30A and tears that side 30A, only to form a pocket 39 which may be filled with an object.

The operation of filling of the bags 40 is despicted in FIG. 7. In FIG. 7 a roll 50 of tube 30 comprising a series of open bags 40 is fed into a machine 51, of substantially standard design. The bags 40 travel over a guide roller 52. Draw rollers 53 pull the bags through the machine into position for loading as at 56. The machine stops the bag material at a preset position so that each bag is in position for loading. An air nozzle 55 shows a jet of air into the bag to force the slitted or side 30A open so that the product can be loaded easily.

A funnel 57 may be used to guide the product into the open bag 40. After loading, pocket 39 is sealed as by a sealing bar to form a completed enclosed package.

Note that the tube 30 runs vertically or downwardly at the filling point and an object can be conveniently loaded, fed or inserted into the pocket 39 of each of bags 40.

Note also that as for tube 10 the objects are loaded, fed or inserted in the side of the bags 40 formed from tube 30. The top of the bags 40, which is the side on which the profile members 31 and 32 are formed are not disturbed and remain closed until the customer or user opens the bag.

Although particular embodiments of the present invention have been described and illustrated herein, it should be recognized that modifications and variations may readily occur to those skilled in the art and that such modifications are variations may be made without departing from one spirit and scope of my invention. Consequently, my invention as claimed below may be practiced otherwise than as specifically described above.

I claim:

1. A plurality of recloseable plastic bags formed from a film of plastic tubing, each: bag comprising:

plastic tubing, having a first lateral edge and a second lateral edge;

plastic cooperation snap fit members protruding from the surface of said, tubing and capable of being selectively joined and unjoined, extended along the length of said, tubing adjacent to, said first lateral edge;

a first heat sealed edge extending between said second lateral edge and said first lateral edge, a second heat sealed edge extending between said second lateral edge ans said first lateral edge, said second heat sealed edge spaced from said first heat sealed edge for forming a pocket therebetween, a perforated line on the side of said snap fit members adjacent to said first edge and a relatively thick flattened heat sealed area comprising a flattened area of said snap fit members, said perforated line extending through said heat sealed area whereby a bag may be conveniently seperated from said tubing by tearing along said perforated line including the portion extending through said flattened area, a slit in a surface of said tubing adjacent to each of the said heat seal edges to form an open pocket in each bag which may receive an object through said slit, and, a heat seal adjacent to the slit such that an object placed through the slit into said pocket maybe sealed within said bag.

2. A plastic bag as in claim 1 having a perforation line along the first lateral edge on the side of the snap fit member opposite to the second lateral edge, whereby access to an object contained in the bag may be obtained by tearing along the perforated line.

* * * * *